US005987341A

United States Patent [19]

Hodge et al.

[11] Patent Number: 5,987,341

[45] Date of Patent: Nov. 16, 1999

[54] HIGH-PURITY POLYCRYSTALLINE ALUMINA CRYOGENIC DIELECTRIC

[75] Inventors: James D. Hodge, Lincolnwood; Stephen K. Remillard, Arlington Heights, both of Ill.

[73] Assignee: Illinois Superconductor Corporation, Mt. Prospect, Ill.

[21] Appl. No.: 08/859,612

[22] Filed: May 20, 1997

Related U.S. Application Data

[63] Continuation-in-part of application No. 08/654,647, May 29, 1996.

[51] Int. Cl.[6] ..... H01P 7/00; H01B 12/02

[52] U.S. Cl. ..... 505/210; 505/700; 505/866; 333/99 S; 333/219

[58] Field of Search ..... 333/99 S, 219; 505/210, 238, 700, 701, 866

[56] References Cited

U.S. PATENT DOCUMENTS

| | | | |
|---|---|---|---|
| 4,936,957 | 6/1990 | Dickey et al. | 205/96 |
| 5,496,797 | 3/1996 | Higaki et al. | 333/99 S X |

FOREIGN PATENT DOCUMENTS

| | | |
|---|---|---|
| WO 97/23429 | 7/1997 | WIPO . |
| WO 97/23430 | 7/1997 | WIPO . |

OTHER PUBLICATIONS

Davidson et al., "Measurements on alumina and glasses using a $TM_{020}$ mode resonant cavity at 9.34 GHz," *PROC.IEE*, vol. 119, No. 12, pp. 1759–1763, Dec. 1972.

Fowler, John D., Jr., "Radiation–Induced RF Loss Measurements and Thermal Stress Calculations for Ceramic Windows," *Journal of Nuclear Materials*, 122 & 123, pp. 1359–1364, (1984).

Hamersky, J., "Contribution of Surface Absorbed Water to the Loss Factor of Polycrystalline $Al_2$ $O_3$," *Interceram*, NR.2, pp. 119–131, (1977).

Kobayashi et al., "Microwave Measurement of Dielectric Properties of Low–Loss Materials by the Dielectric Rod Resonator Method," *IEEE Transactions on Microwave Theory and Techniques*, vol. MTT–33, No. 7, pp. 586–592, Jul. 1985.

Kobayashi et al., "Round Robin Test on a Dielectric Resonator Method for Measuring Complex Permittivity at Microwave Frequency," *IEICE Trans. Electron.*, vol. E77–C, No. 6, pp. 882–887, Jun. 1994.

Pells et al., "Radiation Effects on the Electrical Properties of Alumina From dc to 65 MHz," *Journal of Nuclear Materials*, 141–143, pp. 375–381, (1986).

Penn et al., "Effect of Porosity and Grain Size on the Microwave Dielectric Properties of Sintered Alumina," *J. Am. Ceram. Soc.*, vol. 80, No. 7, pp. 1885–1888, (1997).

Shields et al., "Thick films of YBCO on alumina substrates with zirconia barrier layers," *Supercond. Sci. Technol.*, vol. 5, pp. 627–633, (1992).

*Primary Examiner*—Benny T. Lee

*Attorney, Agent, or Firm*—Marshall, O'Toole, Gerstein, Murray & Borun

[57] ABSTRACT

An electromagnetic device, such as a resonator for a filter, incorporates a high-purity polycrystalline alumina. The device may include a superconducting component, which must be cooled significantly below room temperature. The high-purity polycrystalline alumina may be a dielectric slab in a stripline resonator, or may be used as a stand for holding other components. The high-purity polycrystalline alumina exhibits a very low loss tangent at cryogenic temperatures, and therefore will result in an electromagnetic device with superior performance characteristics.

10 Claims, 3 Drawing Sheets

FIG. 1
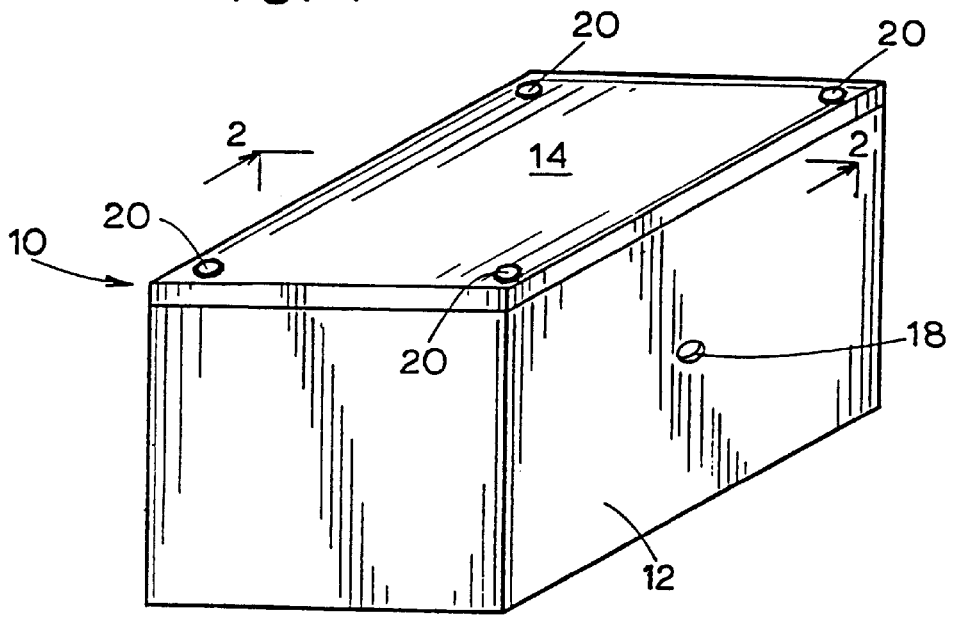
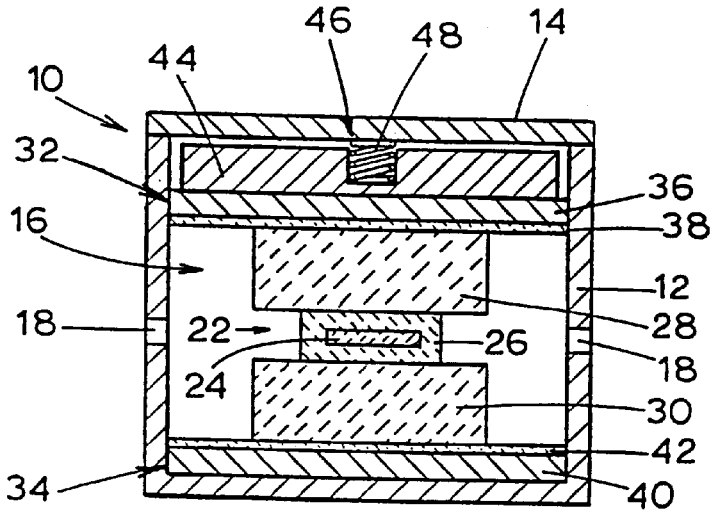
FIG. 2

HIGH-PURITY POLYCRYSTALLINE ALUMINA CRYOGENIC DIELECTRIC

RELATED APPLICATIONS

The present application is a continuation-in-part of U.S. patent application Ser. No. 08/654,647, filed May 29, 1996.

FIELD OF INVENTION

The present invention relates generally to electromagnetic devices, and more particularly to materials used in such electromagnetic devices at cryogenic temperatures.

BACKGROUND OF THE INVENTION

Electromagnetic filters commonly use various dielectric materials in resonators in order to filter unwanted frequencies from an input signal. By loading, or placing a conductor in or adjacent to the dielectric material, the size and thus the cost of such components can be reduced. Because of higher resistance, the use of ordinary conductors will result in significant electromagnetic losses in the component. Superconducting materials have therefore been substituted for the ordinary conductors because of their extremely low surface resistance, and thus low loss.

The use of superconducting materials results in other complications for manufacturing such devices. First, superconducting materials must be cooled to a temperature at or below their critical temperatures in order to have the desirable low surface resistance. Second, in order for superconducting materials to have a significant benefit, the dielectric material used in conjunction with those superconducting materials must have a low loss tangent. The loss tangent of a dielectric material is defined as the ratio of the imaginary term in its permitivity, $\in^*$, to the real term in its permitivity $\in_r$, or tan $\delta=\in^*/\in_r$. It is manifest as a material property in the form of the Q of a resonator made from the dielectric. If a piece of the dielectric is suspended in free space and allowed to resonate, the quality factor Q, of such a resonator will be $Q=1/\tan\delta$. Thus, loss tangent may be measured by placing a sample of the material on a polytetrafluoroethylene (virtually invisible to RF) pedestal and measuring its Q factor. Since a superconducting device will operate at cryogenic temperatures, the dielectric material must exhibit such a low loss tangent at those temperatures.

In most materials, the loss tangent of a dielectric material will decrease as the temperature of that dielectric material decreases. See Shield, T. C. et al., "Thick Films of YBCO on Alumina Substrates with Zirconia Barrier Layers," *Supercond. Sci. Technol.* 5 (1992). However, a dielectric material which exhibits a relatively low loss tangent at room temperature may not have a relatively low loss tangent at cryogenic temperatures.

SUMMARY OF THE INVENTION

In accordance with one aspect of the present invention, an electromagnetic device includes a superconducting element made of a superconducting material. The superconducting material has a critical temperature substantially below room temperature. The device also includes a dielectric element made of a high-purity polycrystalline alumina. The electromagnetic device may include a resonator.

The dielectric element may be more than 99.9% pure polycrystalline alumina. More preferably, the dielectric element may be at least 99.95% pure polycrystalline alumina. Most preferably, the dielectric element may be at least 99.98% pure polycrystalline alumina.

In accordance with another aspect of the present invention, an electromagnetic system may include an electromagnetic device having a high-purity polycrystalline alumina element. The system includes a cryostat encapsulating the electromagnetic device and maintaining the device at a temperature substantially below room temperature. The cryostat may maintain the electromagnetic device at below 90 K. More preferably, the cryostat may maintain the electromagnetic device at below 77 K.

Other features and advantages are inherent in the high-purity polycrystalline alumina devices claimed and disclosed or will become apparent to those skilled in the art from the following detailed description in conjunction with the accompanying drawings.

BRIEF DESCRIPTION OF THE DRAWINGS

FIG. 1 is a perspective view of a housing containing a stripline resonator utilizing the polycrystalline alumina of the present invention;

FIG. 2 is a sectional view of the housing and stripline resonator of FIG. 1 taken along the line 2—2 in FIG. 1;

DETAILED DESCRIPTION OF THE PREFERRED EMBODIMENT

Figure 3:
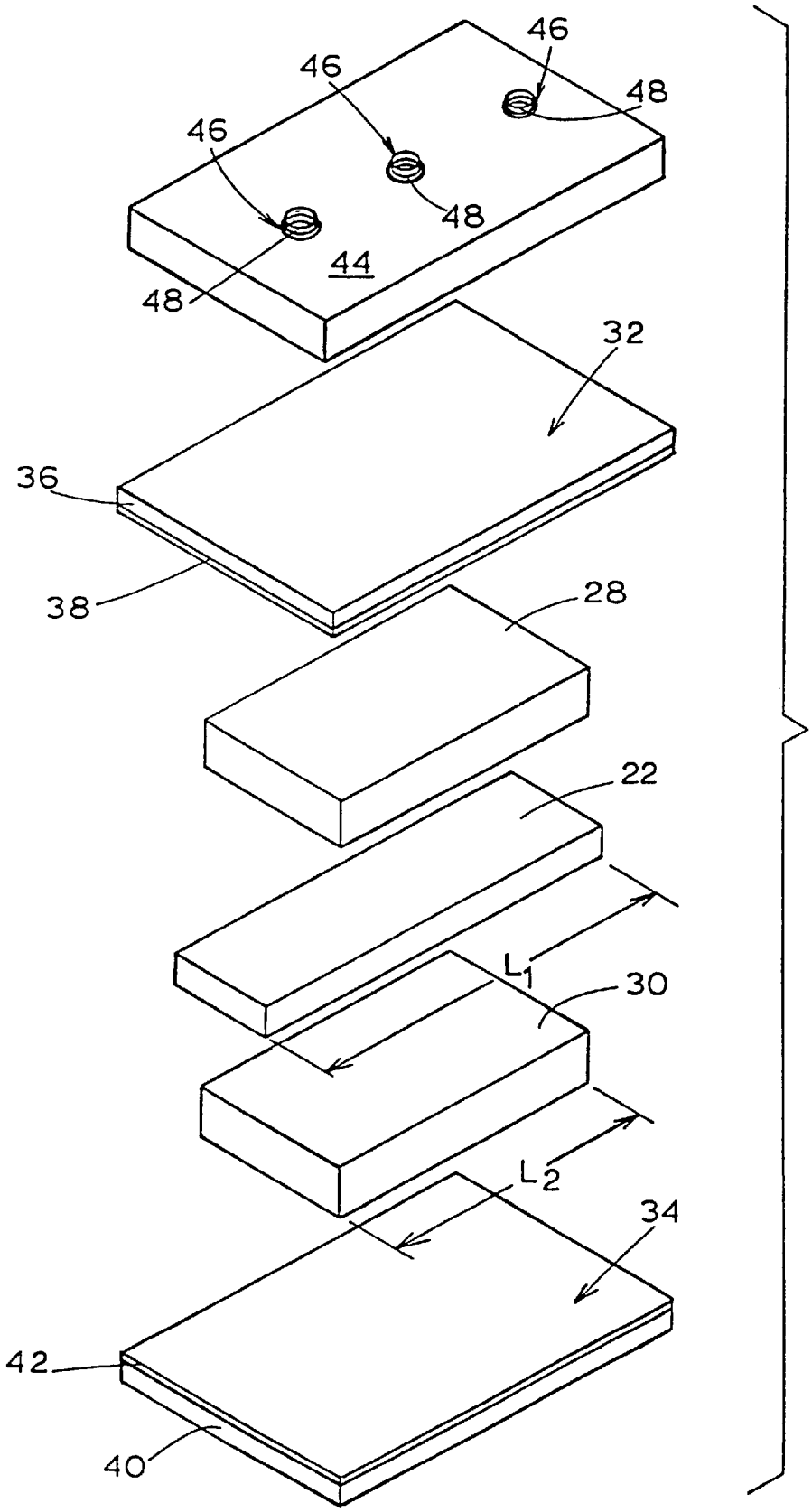
FIG. 3 is an exploded perspective view of the stripline resonator of FIG. 1.

Referring initially to FIGS. 1 and 2, a housing indicated generally at 10 has a base 12 and a cover 14. As seen in FIG. 2, the housing 10 contains a stripline resonator indicated generally at 16. The walls of the base 12 have openings 18 through which a device such as a coupling loop (not depicted) may pass in order to transmit signals to or from the resonator 16. Several bolts 20 secure the cover 14 to the base 12, as seen in FIG. 1.

Referring now to FIGS. 2 and 3, the resonator 16 includes a center conductor indicated generally at 22 having a substrate 24 with a coating 26 of high-temperature superconducting material (FIG. 2). The center conductor 22 is shown in the form of a slab or bar but could be of a different shape such as a rod, disc, spiral, ring, hairpin, etc. The center conductor 22 is sandwiched between an upper dielectric slab 28 and a lower dielectric slab 30. Although two discrete dielectric slabs 28 and 30 are shown in FIGS. 2 and 3, they could be combined into a single dielectric element having an opening or recess for receiving the center conductor 22. The dielectric slabs 28 and 30 are, in turn, sandwiched by an upper ground plane indicated generally at 32 and a lower ground plane indicated generally at 34. The upper ground plane 32 consists of a substrate 36 with a coating 38 of high-temperature superconducting material on its lower surface. Similarly, the lower ground plane 34 includes a substrate 40 with a coating 42 of high-temperature superconducting material on its upper surface. Above the upper ground plane 32 is a plate 44 having three recesses 46 (FIG. 3). Inside the recesses 46 are springs 48 which engage the cover 14 (FIG. 2). The force exerted by the springs 48 through the plate 44 onto the components of the resonator 16 reduces movement and insures maximum contact between the respective surfaces of the resonator components. Absent such a force by the springs 48 (or similar confining pressures), air gaps may be present between adjacent resonator components resulting in losses at the resonant frequency.

Although only a single resonator is shown in FIGS. 1–3, two or more resonators can be connected together to form a filter. The specific dimensions of each component of each resonator will be determined by the desired filtering characteristics of such a filter, as is known in the art.

As seen in FIG. 3, the center conductor 22 has a length $L_1$, and the lower dielectric slab 30 has a length $L_2$. The upper dielectric slab 28 may also have a length $L_2$. $L_1$ is larger than $L_2$ so that the ends of the center conductor 22 extend beyond the ends of the dielectric slabs 28 and 30. Providing a center conductor with a length greater than the dielectric slab has several advantages over conventional stripline resonator designs in which the entire center conductor is covered above and below by dielectric. First, when creating the center conductor 22, it may be heated to melt-texture the superconducting material in the coating 26. During such processing, if the center conductor is held in place by a stand or other structure, the superconducting material may not be properly textured in the area where that material is in contact with a stand. By lengthening the center conductor 22, it can be held during processing at its ends so that any superconductor material damaged by the stand will not be adjacent the high magnetic field energy regions in the resonator 16 between the upper dielectric slab 28 and the lower dielectric slab 30. Second, any damaged superconducting material will not be in contact with the upper dielectric slab 28 or the lower dielectric slab 30 so that maximum physical contact can be achieved between the center conductor 22 and the dielectric, eliminating air pockets in the resonator. Finally, lengthening the center conductor 22 permits shortening of the dielectric slabs 28 and 30 while maintaining the same resonant frequency. As discussed below, the dielectric slabs 28 and 30 may be made of a high purity polycrystalline alumina of the present invention.

Figure 4:
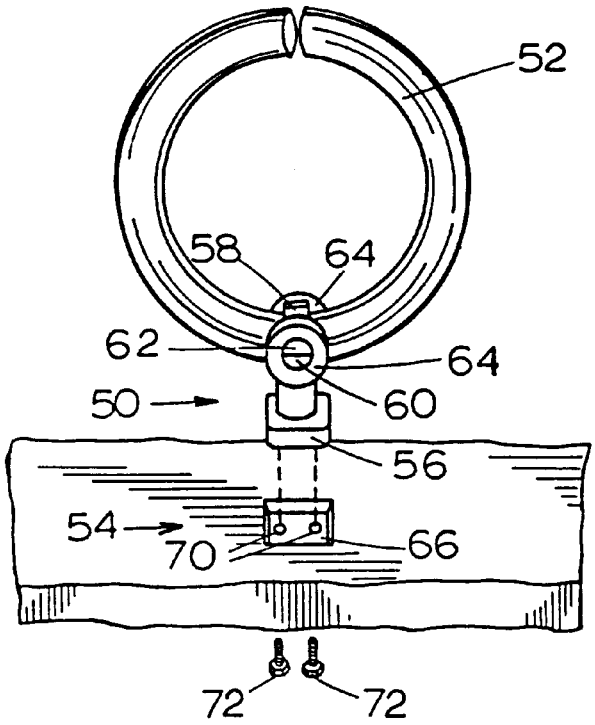
FIG. 4 is an exploded view of a resonator including a resonator stand comprised of the polycrystalline alumina of the present invention.

Referring now to FIG. 4, a mounting mechanism 50 holds a resonant element 52 to a wall 54 of a housing. The wall 54 of the housing forms a cavity in which the resonant element 52 sits to form a resonator. The resonant element 52 is made of a superconducting material, and thus the housing will generally be sealed and cooled to cryogenic temperatures. The mounting mechanism 50 includes a base 56 and a cap 58. The base 56 has wings 60, and the cap 58 has wings 62 which are held together by rings 64. The cap 58 and base 56 have a profile which matches the cross-section of the resonant element 52, so that the base 56 and cap 58 can hold the resonant element 52 securely. An epoxy may be placed between the mounting mechanism 50 and the resonant element 52 to further inhibit movement of the resonant element 52. The wall 54 has a recess 66 in which the mounting mechanism 50 fits. Two holes 70 permits two screws 72 to be inserted from the back side of the wall 54 to secure the stand 50 to the wall 54. The mounting mechanism 50 must be made of a non-electrically conducting or dielectric material in order for the resonant element 52 to operate properly.

Figure 5:
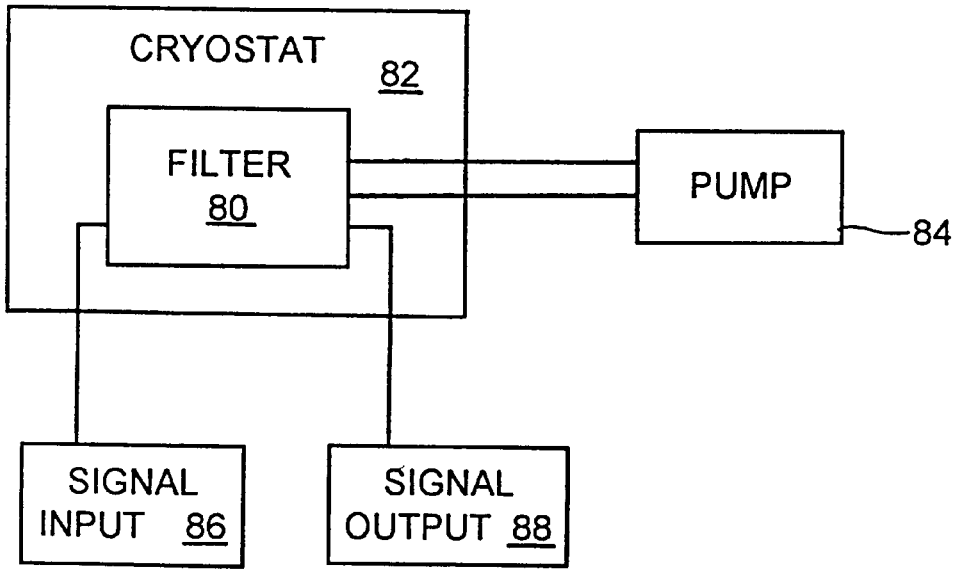
FIG. 5 is a block diagram of an electromagnetic system utilizing the polycrystalline alumina of the present invention.

Referring now to FIG. 5, an electromagnetic system includes a filter 80 located inside a cryostat 82. The filter 80 may include resonators such as those shown in FIGS. 1–3 or in FIG. 4. A pump 84 removes heat from the filter 80 in order to cool the filter to substantially below room temperature. If the filter 80 has superconducting components, those components must be cooled to below 90° K and preferably below 77° K. The cryostat 82 will generally be evacuated in order to minimize any heat being transmitted from outside the cryostat 82 to the filter 80 and its components. The filter 80 receives a signal from a signal input source 86. The type of input source will depend on the application for the filter, but may, for instance, be an antenna or other signal-generating apparatus or device. The filter 80 outputs the signal to a signal output component 88, which may be an amplifier, a signal processor of some other type, or a device which utilizes or transmits the signal.

The dielectric elements 28 and 30 in FIGS. 2 and 3, and the stand 50 in FIG. 4 are preferably made of a high-purity polycrystalline alumina such as LucAlOx™ as manufactured by General Electric. The materials used to manufacture LucAlOx are at least 99.9% pure prior to processing into polycrystalline alumina. After processing, the LucAlOx is at least 99.95% pure and generally at least 99.98% pure. The use of polycrystalline alumina with a very high purity exhibits an unexpectedly low loss tangent at cryogenic temperatures, and therefore results in superior components of resonators for use in electromagnetic filters, when those components are cooled to cryogenic temperatures. Set forth below is a chart showing the loss tangents at room temperature (290° K) and at 77° K for LucAlOx and the polycrystalline alumina of other manufacturers at various purity levels.

TABLE 1

| Supplier/Purity | Frequency (GHz) | tan δ (290° K.) | tan δ (77° K.) |
|---|---|---|---|
| LucAlOx > 99.9% | 5.5 | $(1.4 \pm .1) \times 10^{-4}$ | $(3.0 \pm .4) \times 10^{-6}$ |
| LucAlOx > 99.9% | 13.1 | $(3.62 \pm .2) \times 10^{-5}$ | $(3.8 \pm .4) \times 10^{-6}$ |
| Coors 99.8% | 7 | $(5.31 \pm .03) \times 10^{-5}$ | $(4.11 \pm .5) \times 10^{-5}$ |
| Morgan 99.5% | 7 | $(5.32 \pm .12) \times 10^{-5}$ | $(3.26 \pm .5) \times 10^{-5}$ |

The loss tangents for the materials were determined by obtaining two samples of each material. Each sample is a right cylinder, with the first cylinder having a length L and a second cylinder having a length 2 L. Each sample was sandwiched between two conducting sheets to form a resonator. See, W. E. Courtney, "Analysis and Evaluation of a Method of Measuring the Complex Permitivity and Permeability of Microwave Insulators," *IEEE Transactions on Microwave Theory and Techniques*, Vol. MTT-18, pp. 476–485, August 1970. The resonant frequency of the short sample $f_s$, and the quality factor $Q_s$ of the resonator were measured in the $TE_{011}$ mode. The longer sample is then tested to determine $f_L$ and $Q_L$ in the $TE_{012}$ mode. Because the long cylinder is twice the length of the short cylinder, the resonant frequency of the $TE_{012}$ mode of the long cylinder is identical to the short cylinder's frequency in the $TE_{011}$ mode. Once the quality factor has been found for each resonator, the loss tangent for a particular frequency is governed by the equation:

$$\tan \delta = A(1/Q_s - 1/Q_L)$$

where A is a constant depending on the geometry of the resonator and the test frequency. The constant A can be computed from equations published in Y. Kobayashi and M. Katoh, "Microwave Measurements of Dielectric Properties of Low-Loss Materials by the Dielectric Rod Resonator Method," *IEEE Transactions on Microwave Theory and Techniques*, Vol. MTT-33, pp.586–592, July 1985.

As can be seen from Table 1, all materials experienced an improvement (a decrease) in the loss tangent as temperature decreased. However, the chart below shows that the ratio of loss tangent at 77° K as compared to 290° K (tan δ (77°)/tan δ (290°)) is significantly lower for the high-purity materials.

TABLE 2

| Material | $\frac{\tan\delta(77° K)}{\tan\delta(290° K)}$ |
|---|---|
| LucAlOx (5.5 Ghz) | .021 ± .004 |
| LucAlOx (13.1 Ghz) | .10 ± .02 |
| Coors 99.8% | .77 ± .10 |
| Morgan 99.5 | .61 ± .10 |

As can be seen from Table 2, the improvement in loss tangent for LucAlOx at either of the tested frequencies was unexpectedly high, compared with the relatively modest improvement for the lower purity polycrystalline aluminas. This unexpectedly low loss tangent for high-purity polycrystalline alumina at cryogenic temperatures makes it an excellent material to be used in conjunction with superconductors. The low loss tangent also makes the material an excellent choice for other low temperature applications which require dielectric material.

The housings or walls of the resonators can be made of any suitably sturdy material having a conducting or superconducting surface, but are preferably made from a conductor such as copper or silver-plated aluminum or brass. The substrates 36 and 40 may be made of a conductor in order to provide good electrical contact between the ground planes 32, 34 and the housing 10 which may be considered electrical ground. The superconductor coatings are preferably a thick film of high-temperature superconductor, which can be applied by any known method. If the superconductor coating is $YBa_2Cu_3O_{7-x}$, it can be applied in accordance with the teachings of U.S. Pat. No. 5,340,797, which is incorporated herein by reference. If the method of U.S. Pat. No. 5,340,797 is used, the substrates for coating will be metal made of, or coated with, silver prior to coating with the superconductor.

The superconducting elements may also be manufactured by using the following method with a variety of substrates including, zirconia, magnesia or titanium. To manufacture one kilogram of the superconductor coating, 640.6 grams of barium carbonate, 387.4 grams of cupric oxide, and 183.2 grams of yttrium oxide are dried and mixed together with zirconia grinding beads and 500 milliliters of absolute ethanol. The mixture is then vibramilled for 4 hours, dried, sieved, and freeze-dried for 12 hours. The powder is transferred to alumina boats and placed in a calcination furnace where the temperature is raised 10° C. per minute to 860° C. where it remains for 16 hours. The furnace is then cooled at 50° C. per minute to room temperature. The calcined powder is vibramilled for 16 hours, rotary evaporated, sieved, and freeze-dried for 12 additional hours.

A vehicle, to be mixed with the superconductor powder to form a coating ink, is made using ingredients in the following weight percents:

| | |
|---|---|
| Terpineol | 43.6% |
| 2-(2-Butoxy) Ethyl-Acetate (BCA) | 43.6% |
| Paraloid B 67 ™ acrylic resin, made by Rohm & Haas | 5.73% |
| Ehec-Ri Cellulose | 2.12% |
| T-200 Cellulose | 2.35% |
| N-4 Cellulose | 2.6% |

The Paraloid B-67 is dissolved in the Terpineol and 2-(2-Butoxy)Ethyl-Acetate (BCA) with a magnetic stirrer for 24 hours. The remaining ingredients are mixed together and slowly added to the solvent mixture and then left to dissolve while stirring for 12 hours.

The powder is then hand mixed with the vehicle on an alumina or glass plate, 20% vehicle by weight to 80% powder. The vehicle-powder mixture is milled on a three-roll mill with the gap between the back rollers set at 0.01 inches and the front rollers set at 0.001 inches. Each ink is passed through the mill rollers three times and then left to stand for 24 hours. Ink is applied to the substrates using any conventional coating method including dipping, doctor blading, and screen printing.

In order to obtain the desired microstructure, the superconductor coating is melt-textured in a furnace having an oxygen atmosphere having a pressure at about 760 torr. The furnace is heated from room temperature at about 10° C. per minute to about 1050° C. The furnace remains at 1050° C. for six minutes and then is cooled at about 2° C. per minute to room temperature. Although substrates are preferably used for manufacturing the superconducting components, they can each be made from bulk or sintered superconductor materials having a desirable microstructure.

The foregoing detailed description has been given for clearness of understanding only, and no unnecessary limitations should be understood therefrom, as modifications would be obvious to those skilled in the art.

We claim:

1. An electromagnetic device comprising:

a superconducting element comprised of a superconducting material, wherein the superconducting material has a critical temperature substantially below room temperature; and a dielectric element, located adjacent to the superconducting element wherein the dielectric element comprises a high-purity polycrystalline alumina which is at least 99.9% pure polycrystalline alumina.

2. The electromagnetic device of claim 1 wherein the dielectric element is at least 99.98% pure polycrystalline alumina.

3. The electromagnetic device of claim 1 wherein the dielectric element is a component of a resonator.

4. The electromagnetic device of claim 1 wherein the dielectric element is at least 99.95% pure polycrystalline alumina.

5. An electromagnetic system comprising:

an electromagnetic device comprising a high-purity polycrystalline alumina element which is at least 99.9% pure polycrystalline alumina; and a cryostat encapsulating the electromagnetic device and maintaining the device at a temperature substantially below room temperature.

6. The electromagnetic device of claim 5 wherein the polycrystalline alumina element is at least 99.95% pure polycrystalline alumina.

7. The electromagnetic device of claim 5 wherein the polycrystalline alumina element is at least 99.98% pure polycrystalline alumina.

8. The system of claim 5 wherein the cryostat maintains the temperature of the electromagnetic device at below 90 K.

9. The system of claim 8 wherein the cryostat maintains the temperature of the electromagnetic device at below 77 K.

10. The electromagnetic device of claim 5 wherein the polycrystalline alumina element is a component of a resonator.

* * * * *